US009937613B2

(12) United States Patent
Saf et al.

(10) Patent No.: US 9,937,613 B2
(45) Date of Patent: Apr. 10, 2018

(54) STRIKER MEMBER, AND A DRILLING MACHINE COMPRISING A STRIKER MEMBER

(75) Inventors: Fredrik Saf, Vintrosa (SE); Thomas Östling, Eskilstuna (SE)

(73) Assignee: Atlas Copco Rock Drills AB, Orebro (SE)

( * ) Notice: Subject to any disclaimer, the term of this patent is extended or adjusted under 35 U.S.C. 154(b) by 1235 days.

(21) Appl. No.: 13/261,746

(22) PCT Filed: Apr. 12, 2012

(86) PCT No.: PCT/SE2012/050391

§ 371 (c)(1),
(2), (4) Date: Sep. 23, 2013

(87) PCT Pub. No.: WO2012/150895

PCT Pub. Date: Nov. 8, 2012

(65) Prior Publication Data

US 2014/0041888 A1 Feb. 13, 2014

(30) Foreign Application Priority Data

May 3, 2011 (SE) ..... 1150383

(51) Int. Cl.
*E21B 1/38* (2006.01)
*E21B 6/04* (2006.01)
(Continued)

(52) U.S. Cl.
CPC ..... *B25D 17/06* (2013.01); *E21B 6/00* (2013.01); *B25D 2217/0023* (2013.01)

(58) Field of Classification Search
CPC ..... B25D 17/06; B25D 9/125; B25D 17/245; E21B 6/04; E21B 1/38
(Continued)

(56) References Cited

U.S. PATENT DOCUMENTS 3,150,488 A * 9/1964 Haley ..... B25C 1/04 173/170
4,084,646 A 4/1978 Kurt
(Continued)

FOREIGN PATENT DOCUMENTS

CN 2871120 2/2007
CN 2875719 3/2007
(Continued)

*Primary Examiner* — Nathaniel Chukwurah
*Assistant Examiner* — Mary Hibbert
(74) *Attorney, Agent, or Firm* — Mark P. Stone

(57) ABSTRACT

A circular cylindrical striker member 2 for a drilling machine adapted to transfer kinetic energy to an impulse receiving member 4. The striker member has a diameter $d_{max}$, and includes a side surface 12 and an impulse surface (6). The striker member is adapted to transfer the kinetic energy to the impulse receiving member by a ring shaped active surface of the impulse surface, wherein the ring shaped active surface is concentric with regard to the cross section of the striker member, has a diameter $d_a$, where $d_a<d_{max}$, and has a width $w_a$ that during the contact moment with the impulse receiving part is less than 0.2 $d_{max}$.

19 Claims, 3 Drawing Sheets

(51) Int. Cl.
*B25D 17/06* (2006.01)
*E21B 6/00* (2006.01)

(58) Field of Classification Search
USPC ..... 173/90, 17, 73, 78, 103, 204, 56
See application file for complete search history.

(56) References Cited

U.S. PATENT DOCUMENTS

| | | | | | |
|---|---|---|---|---|---|
| 4,192,391 | A * | 3/1980 | Kastreuz | B25D 16/00 | 173/201 |
| 4,798,249 | A | 1/1989 | Hoereth et al. | | |
| 5,259,464 | A | 11/1993 | Bartels et al. | | |
| 5,562,170 | A * | 10/1996 | Wolfer | E21B 4/14 | 173/208 |
| 2002/0008420 | A1 | 1/2002 | Klemm | | |
| 2009/0133893 | A1 | 5/2009 | Zhong et al. | | |
| 2009/0308627 | A1* | 12/2009 | Andersson | B25D 17/06 | 173/128 |

FOREIGN PATENT DOCUMENTS

| | | |
|---|---|---|
| EP | 1 157 787 | 11/2001 |
| GB | 324265 | 1/1930 |
| GB | 2136725 | 9/1984 |
| JP | 7-506644 | 7/1995 |
| WO | WO 93/23651 | 11/1993 |
| WO | WO 2008/041906 | 4/2008 |

* cited by examiner

STRIKER MEMBER, AND A DRILLING MACHINE COMPRISING A STRIKER MEMBER

FIELD OF THE INVENTION

The present invention relates to striker member, and a drilling machine comprising a striker member, according to the preambles of the independent claims. According to a specific embodiment the striker member is a percussion piston.

BACKGROUND OF THE INVENTION

Hydraulic and pneumatic drilling machines comprise a striker member, e.g. a percussion piston, to transfer shock waves to an impact receiving member, e.g. a shank, which transfers these to the drill rod that via the boar crown penetrates the rock.

A percussion piston preferably strikes using a frequency of approximately 40-100 Hz and the stroke rate for the percussion piston is approximately 10 m/s, which thereby is subjected to high stresses.

If, for example, the percussion piston is exchanged after approximately 1000 hours it is during that time subjected to many load changes, which increases the risk for fatigue failure. It would be advantageous to increase the stroke rate to 12.5-13 m/s.

There are numerous ways to design the impact surface of the percussion piston. A number of known designs are schematically illustrated in FIGS. 2*a*-2*c*.

In FIG. 2*a* is shown a percussion piston having a plane impact surface and provided with a radius transition of 2 (shown in the figure) or 3 mm (R2, R3) to the side surface.

As an alternative, a chamfer angled in relation to the impact surface is provided, where the angle is within the interval of 15-45 degrees. This is illustrated in FIG. 2*b*.

According to still another alternative percussion pistons are provided with a radius covering the entire surface having a radius transition in the interval of 200-1000 mm (R200-R1000). This alternative is illustrated in FIG. 2*c*.

The British patent document GB-324265 is disclosed a hammer rock drill comprising a percussion piston having an impact surface shaped such that the load on the moving part decreases due to a working tool being mounted out of alignment. Therefore, the impact surface of the percussion piston has a spherical concave shape and the shank has a corresponding spherical convex shape.

In the published patent application GB-2136725 a drill hammer provided with a striker is known, where the striker has a truncated cone shaped striker head, i.e. the transition between the side surface and the impact surface is chamfered.

In U.S. Pat. No. 6,273,199 an arrangement is disclosed applicable for rock drilling which includes a percussion piston and a shank.

And finally, the U.S. patent application US-2009/0133893 discloses a hand-held tool having a reciprocating percussion piston. The piston is provided with a spherical impact surface.

There exist both solid percussion pistons as well as percussion pistons provided with a central longitudinal opening.

The shank, to which the percussion piston transfers the shock wave, may be provided with a so called dowel hole at the surface hit by the percussion piston. The dowel hole is a centrally positioned hole which is related to the manufacture of the shank. The dowel hole may have a diameter of e.g. 8 mm.

The dowel hole incurs specific stresses upon the central parts of the impact surface of the percussion piston. Due to the large forces that the impact surface is subjected to it has been established that the central parts are subjected to material movements that briefly may be explained as the parts of the percussion piston above the dowel hole "moves" in the striking direction.

Herein it is important to mention that the shank wears out and replaces more often than the percussion piston.

In addition it has been established that due to wear out of e.g. bushings and so called guide sleeves the percussion piston does not hit the shank entirely straight in every strike. This results in high contact stresses at the contact surfaces.

Thus, in view of the above discussion of the prior art the object of the present invention is to achieve an improved design of the front part of the striker member that minimizes the stress concentration and thereby increases the life for the striker member which is economically favorable.

SUMMARY OF THE INVENTION

The above-mentioned object is achieved by the present invention according to the independent claim.

Preferred embodiments are set forth in the dependent claims.

According to the present invention the striker member is provided with a ring shaped active surface which is concentric in relation to the cross sectional surface of the striker member, has a diameter which is less than the diameter of the percussion piston, and that the active surface has a width that during the contact moment with the impulse receiving member is essentially less than the percussion piston diameter. This applies for a straight impact between the striker member and the impulse receiving member.

When applying the striker member in accordance with the present invention tests have shown that the strike rate may be increased by at least 20%, from e.g. 10 m/s to above 12 m/s. In addition the advantage is achieved that by using the striker member according to the present invention at strike rates normally used today a longer lifetime is obtained, and a better resistance to non-straight impacts.

According to the present invention the impact surface is given a shape that minimizes the stress concentration. Due to the ring shaped active surface the contact point is moved away from the side surface and closer to the center of the impact surface, which is advantageous in that a more even distribution of the forces applied to the striker member then is achieved.

Also in relation to a non-straight impact between the striker member and the impulse receiving member a more advantageous minimization of the stress concentration is achieved according to the invention in that e.g. the contact surface is larger and the contact point is moved away from the side surface and more to the center of the impact surface.

According to a preferred embodiment the central parts of the impact surface is provided with an indentation that in its most central parts may be provided by a central pin. By means of the central pin it has been observed that the shock waves are spread away from the central parts of the striker member, which is advantageous in that the central parts of the striker member then not is subjected to extreme loads.

SHORT DESCRIPTION OF THE APPENDED DRAWINGS

FIG. 1 is a side view that schematically illustrates parts of a drilling machine where the present invention may be applied.

FIGS. 2*a*-2*c* are side views that schematically illustrate different known shapes of the impact surface.

Figure 5A:
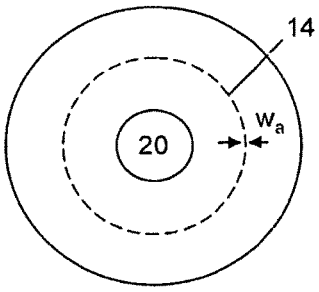
Figure 5B:
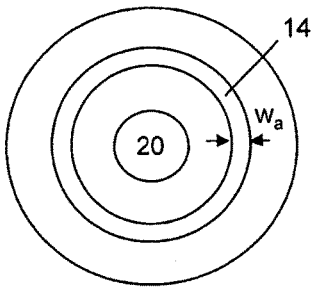
Figure 5C:
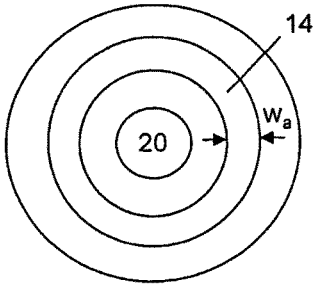

FIGS. 5*a*-5*c* are a front views against the strike direction that schematically illustrate the impact surface during a straight strike according to the first embodiment of the present invention.

Figure 6A:
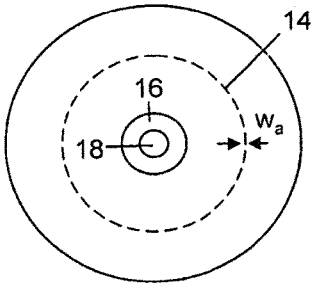
Figure 6B:
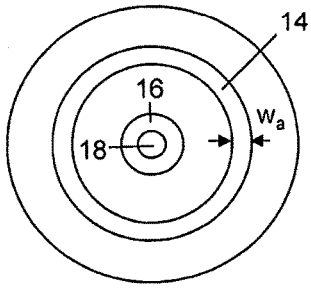
Figure 6C:
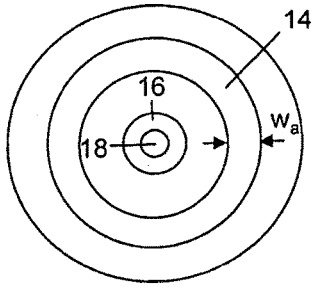

FIGS. 6*a*-6*c* are front views against the strike direction that schematically illustrate the impact surface during a straight strike according to the second embodiment of the present invention.

Figure 7A:
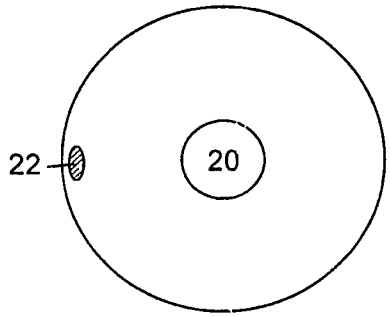
Figure 7B:
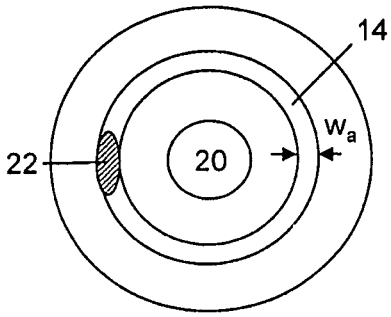

FIGS. 7*a* and 7*b* illustrate an impact surface according to prior art and according to the first embodiment of the present invention, respectively.

Figure 8A:
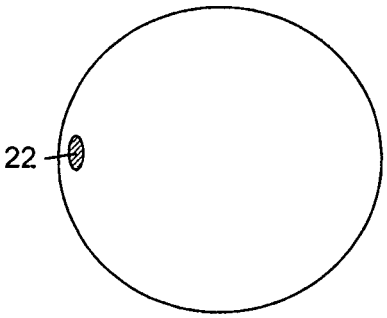
Figure 8B:
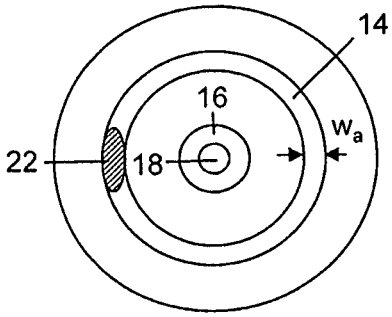

FIGS. 8*a* and 8*b* illustrate an impact surface according to prior art and according to the second embodiment of the present invention, respectively.

DETAILED DESCRIPTION OF PREFERRED EMBODIMENTS OF THE INVENTION

As used herein, the terms "impact" and "impulse" are intended to be equivalents.

Figure 1:
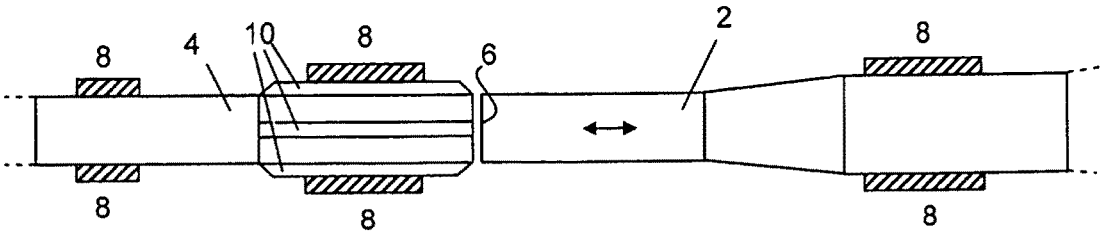

FIG. 1 is a schematic drawing of parts of a drilling machine where the present invention may be applied.

In FIG. 1 the invention is illustrated by showing a striker member in the form of a percussion piston and how it cooperates with a shank. However, the present invention is generally applicable in other parts of a drilling machine for transfer of shock waves. For example between the percussion piston and the shank, between the shank and the drill rod, and between the drill rod and the boar. crown. The invention will be exemplified in detail by describing an implementation in relation to a percussion piston.

Thus, with references to FIG. 1 a percussion piston 2 is shown, adapted to perform a reciprocating movement which is illustrated by the double arrow. The percussion piston is arranged to transfer its kinetic energy in the form of shock waves to a shank 4. The shock waves are created during the contact moment between the front surface of the percussion piston, the impact surface 6, and the shank.

The percussion piston and the shank have an essentially circular cross-section and being arranged in a drilling machine housing (not shown) by means of a number of bushings 8 to permit movement in the longitudinal direction. The bushings are only schematically illustrated in the figure. The number of bushings and their exact position may of course vary in dependent of the type of drilling machine.

A rotation is applied to the shank that then transfers this kinetic energy and the shock wave energy to a drilling rod (not shown) that in its turn is provided with a boar crown (not shown) for rock drilling.

The housing of the drilling machine comprises in its front part and around the shank a part that may be opened in order to replace the shank. The rotation is generated by a motor (not shown) and is supplied to the shank via a number of splines 10.

Figure 3:
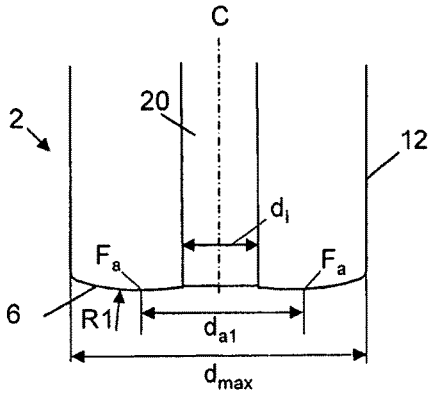
FIG. 3 is a side view that schematically illustrates the front part of a percussion piston according to a first embodiment of the present invention.
Figure 4:
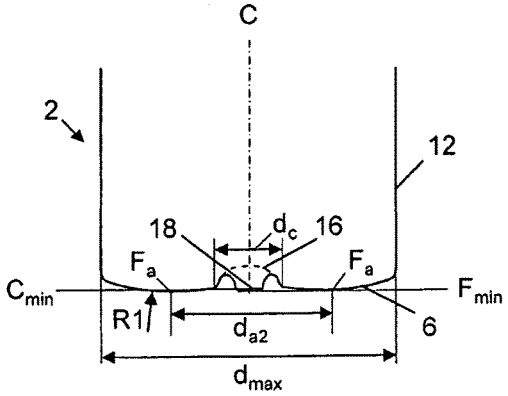
FIG. 4 is a side view that schematically illustrates the front part of a percussion piston according to a second embodiment of the present invention.

The invention will now be described with references to the FIGS. 3-6. FIGS. 3 and 5 illustrate the first embodiment and FIGS. 4 and 6 illustrate the second embodiment. It should be noted That the impact surface shown in FIGS. 5 and 6 illustrates how the active surface changes during a straight impact.

The present invention relates to a circular cylindrical striker member 2, herein illustrated as a percussion piston 2, for a drilling machine, adapted to transfer kinetic energy to an impact receiving member 4, herein illustrated as a shank 4 (see FIG. 1). The percussion piston has a diameter $d_{max}$, and comprises a side surface 12 and an impact surface 6. According to the invention the striker member (percussion piston) is adapted to transfer kinetic energy to the striker member (shank) by means of a ring shaped active surface 14 (see FIGS. 5 and 6) of the impact surface where the shock waves are created between the active surface and the impact receiving member. The ring shaped active surface is concentric in relation to the cross-sectional surface of the striker member (percussion piston), and has a diameter of $d_a$, where $d_a<d_{max}$, preferably $d_a<0.75\ d_{max}$. The active surface has a width $w_a$ that during the contact moment with impact receiving member is much less than $d_{max}$, and preferably less than 0.2 $d_{max}$. The diameter $d_a$ of the ring shaped active surface is the diameter of a circle placed such that it is concentrically positioned on the active surface.

FIGS. 3 and 4 show cross-sectional views, along the centre axis C, of the striker member. In this view the impact surface 6 displays a curve form having a minimum value $F_{min}$ in the area for the ring shaped active surface. The impact surface may also be, described as it is provided with a ring shaped convex form in the striking direction.

The striker member diameter $d_{max}$ in relation to the impact surface is 10-300, preferably 20-60 mm.

The curve shape formed by the impact surface has a radius transition R1 in the interval of 50-500 mm.

This may also be expressed as the curve has a radius transition R1, where R1/$d_{max}$ is in the interval of 1-50.

The convex shape may naturally be provided with several transition radii, e.g. a first transition radius in the area of the active surface and a second transition area in the transition surface between the impact surface and the side surface where the transition surface is, approximately 1-3 mm. preferably the transition radius is largest in the area of the active surface.

Even more complicated shapes of the surface are possible, for example the surface may be partly planar and the transition surface may be chamfered.

The first embodiment relates to a hollow striker member (percussion piston) (FIGS. 3, and 5*a*-5*c*) and the second embodiment relates to a solid striker member (percussion piston) (FIGS. 4, and 6*a*-6*c*).

According to the first embodiment, shown in FIGS. 3 and 5, the percussion piston is provided with a longitudinal cavity 20 concentrically running along the centre axis of the percussion piston. The cavity has a diameter $d_i$, where $d_i<d_{max}/2$.

The diameter $d_{a1}$ defines the position of the active surface according to the first embodiment where $d_{a1}$ is in the interval of 0.25 $(d_{max}+d_i)$ to 0.75 $(d_{max}+d_i)$. According to one example the position for the active surface is between $d_i$ and $d_{max}$, which may be expressed as $d_{a1}=0.5\ d_{max}+0.5\ d_i$.

Figures 2A, 2B, 2C:
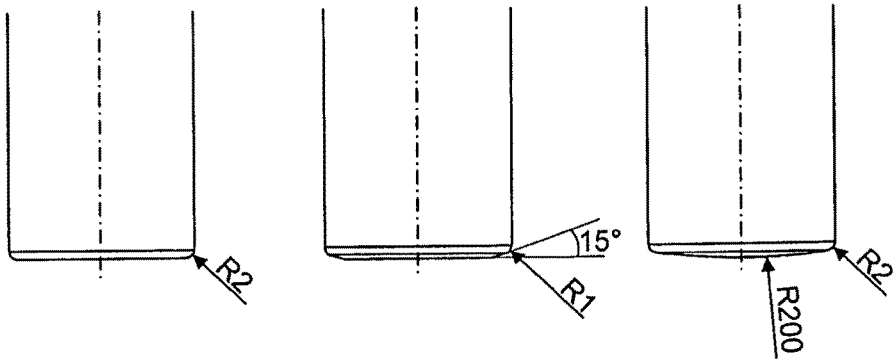

According to the second embodiment, which is shown in FIGS. 4 and 6, where the percussion piston is solid, the central parts of the impact surface is provided with an indentation 16 in a direction away from the striking direction, and that the indentation has a diameter $d_c$, where $d_c<d_{max}/2$. In FIG. 2 parts of the indentation is marked with dashes.

The diameter $d_{a2}$ defines the position of the active surface in the second embodiment, where $d_{a2}$ is in the interval of 0.25 ($d_{max}+d_c$) to 0.75 ($d_{max}+d_c$). According to one example the position for the active surface is between $d_c$ and $d_{max}$, which may be expressed as $d_{a2}=0.5\ d_{max}+0.5\ d_c$.

According to a variation of the second embodiment the central parts of the indentation 16 is provided with a convex central pin 18 directed in the striking direction.

In FIG. 4, the position of the central pin in the longitudinal direction has been designated by $C_{min}$.

The difference between $C_{min}$ and $F_{min}$ is approximately 0-1.5 mm, e.g. 0.1 mm, i.e. the active impact surface 14 is at the same level, or slightly ahead, in the striking direction in comparison to the lowest part of the central pin. The central pin may be provided with a groove (not shown) in its centre, which is there due to the manufacturing procedure.

FIGS. 5*a*-5*c* and 6*a*-6*c* schematically illustrate how a straight impulse influences the active surface.

In FIGS. 5*a* and 6*a* it is shown the impact surface with the active surface exactly at the contact moment with the impact receiving part. The width $w_a$ of the active surface is then thinnest.

In FIGS. 5*b* and 6*b* it is shown how the width of the active surface increases during the impulse, and FIGS. 5*c* and 6*c* show the width of the active surface during the end of the contact period.

In the figures it is shown how the active surface, the contact surface between the parts, increases by time during the impact to reach a maximum value when the impulse power is as largest. Then the active surface decreases until the parts no longer contact each other. The width, and thus the size, for the active surface is dependent upon the load.

Thus, an important aspect of the present invention is that the active surface at the moment of the first contact between the parts is small in comparison to the size of the impact surface. This applies for a straight impulse.

The FIGS. 5*a*-5*c* and 6*a*-6*c* is an illustration how the striker member, according to the present invention, effectively absorbs and distributes the forces it is subjected to during an impulse.

FIGS. 7*a*, 7*b* (with a longitudinal cavity 20) and 8*a*, 8*b* (solid) schematically illustrate the impulse surface seen from the striking direction when the striker member does not hit the impulse receiving member straight, i.e. the case with a non-straight impulse which may occur when bearings or bushings are worn.

The FIGS. 7*a* and 8*a* illustrate the contact surface 22 a predetermined point of time after the first contact between the striker member and the impulse receiving member, where the striker member is designed in accordance with the prior art and where the radius transition between the side surface and the impulse surface is approximately 1-3 mm. As is shown in the FIGS. 7*a* and 8*a* the contact surface is small and is positioned close to the side surface which in turn implies that the striker member is subjected to high contact tensions which not is desirable as it negatively influences the life time.

The FIGS. 7*b* and 8*b* illustrate the contact surface 22 a predetermined point of time after the first contact between the striker member and the impulse receiving member, where the striker member is designed in accordance with the present invention and where FIG. 7*b* illustrates the first embodiment and FIG. 8*b* illustrates the second embodiment. In these figures the same reference signs as in the other figures are used. As shown from these figures the contact surface 22 is considerably larger than in FIGS. 7*a* and 8*a*, and in addition positioned much closer to the centre of the impulse surface, which together result in a considerable lower contact tensions in comparison to the prior art.

The present invention also relates to a drilling machine including a striker member, e.g. a percussion piston, according to the embodiments disclosed herein. The striker member is preferably hydraulically driven, but the present invention is naturally also applicable in pneumatically driven drilling machines.

In the drilling machine the shock waves are transferred to the impulse receiving member, e.g. the shank, at a rate of approximately 12-13 m/s using a frequency of 40-100 Hz. Other rates and frequencies are of course possible within the scope of the present invention as defined by the appended claims.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A circular cylindrical striker member (2) for a drilling machine adapted to transfer kinetic energy to an impulse receiving member (4) by shock waves created during contact between the striker member and the impulse receiving member, the striker member has a diameter $d_{max}$, and includes a side surface (12) and an impulse surface (6), wherein:

the impulse surface (6) has a ring shaped convex form in the striking direction and comprises a ring shaped active surface (14), and wherein the striker member (2) is adapted to transfer the kinetic energy to the impulse receiving member (4) by means of the ring shaped active surface (14) of the impulse surface (6), wherein the ring shaped active surface (14) is concentric with regard to the cross section of the striker member (2) and has a convex form in the striking direction, wherein the active surface of the striker member increases during impacts between the striker member and the impulse receiving member, wherein the active surface (14) has a diameter $d_a$, wherein the diameter $d_a$ is the diameter of a circle placed concentrically on the active surface (14) and where $d_a<0.75\ d_{max}$.

2. The striker member according to claim 1, wherein the impulse surface (6) displays, in a view along the centre axis C of the striker member, a curve having a minimum value $F_{min}$ in the area for the ring shaped active surface (14).

3. The striker member according to claim 2, wherein the curve shape displays a radius transition R1 in the interval of 10-500 mm.

4. The striker member according to claim 2, wherein the curve shape displays a radius transition R1, where R1/$d_{max}$ is in the interval 1-50.

5. A drilling machine comprising a striker member according to claim 3.

6. A drilling machine comprising a striker member according to claim 2.

7. The striker member according to claim 1, wherein $d_{max}$ is 10-200 mm, preferably 25-60 mm.

8. The striker member according to claim 7, wherein the impulse surface (6) displays, in a view along the centre axis C of the striker member, a curve having a minimum value Fmin in the area for the ring shaped active surface.

9. The striker member according to claim 7, wherein the curve shape displays a radius transition R1 in the interval of 10-500 mm.

10. A drilling machine comprising a striker member according to claim 7.

11. The striker member according to claim 1, wherein the striker member is solid and the centre parts of the impulse surface is provided with an indentation (16) in the direction away from the striking direction, and that the indentation has a diameter $d_c$, where $d_c<d_{max}/2$.

12. The striker member according to claim 11, wherein $d_a$ has a value $d_{a2}$ in the interval 0.25 $(d_{max}+d_c)$ to 0.75 $(d_{max}+d_c)$.

13. The striker member according to claim 12, wherein the indentation (16) in its centre is provided with a convex central pin (18) in the striking direction.

14. The striker member according to claim 11, wherein the indentation (16) in its centre is provided with a convex central pin (18) in the striking-direction.

15. The striker member according to claim 1, wherein the striker member is provided with a longitudinal cavity (20) running concentrically with regard to the centre axis of the striker member, where said cavity has a diameter $d_i$, where $d_i<d_{max}/2$.

16. The striker member according to claim 15, wherein $d_a$ has a value $d_{a1}$ in the interval 0.25 $(d_{max}+d_i)$ to 0.75 $(d_{max}+d_i)$.

17. The striker member according to claim 1, wherein said striker member is a percussion piston for a drilling machine and that said impulse receiving member is a shank for said drilling machine.

18. A drilling machine comprising a striker member according to claim 1.

19. The drilling machine according to claim 18, wherein the shock waves is transferred by the striker member to the impulse receiving member by a rate of 12-13 m/s and by a frequency of 40-100 Hz.

* * * * *